US005437485A

United States Patent [19]

Goldschmidt

[11] Patent Number: 5,437,485

[45] Date of Patent: Aug. 1, 1995

[54] LOCKING MECHANISM FOR WINDOWS OR DOORS

[75] Inventor: Hans-Gerd Goldschmidt, Heiligenhaus, Germany

[73] Assignees: Schüco International KG, Bielefeld; Gebr.Goldschmidt Baubeschläge GmbH, Heiligenhaus, both of Germany

[21] Appl. No.: 214,940

[22] Filed: Mar. 17, 1994

[30] Foreign Application Priority Data

Mar. 19, 1993 [DE] Germany ..... 43 08 810.4

[51] Int. Cl.[6] ..... E05C 9/18

[52] U.S. Cl. ..... 292/142; 49/362

[58] Field of Search ..... 292/142, 22, 39, 160, 292/279, DIG. 20; 49/100, 362, 138; 74/89.17

[56] References Cited

U.S. PATENT DOCUMENTS

| | | | |
|---|---|---|---|
| 4,458,928 | 7/1984 | Hirschbein | 292/279 |
| 4,921,285 | 5/1990 | Loos | 292/142 |
| 5,102,174 | 4/1992 | Prevot | 292/336.3 |
| 5,245,846 | 9/1993 | James | 292/39 |
| 5,265,452 | 11/1993 | Dawson et al. | 292/142 |

FOREIGN PATENT DOCUMENTS

| | | | |
|---|---|---|---|
| 548893 | 11/1957 | Canada | 292/279 |
| 740401 | 1/1933 | France | 292/279 |
| 8814754 U | 11/1988 | Germany . | |

*Primary Examiner*—Peter M. Cuomo
*Assistant Examiner*—Monica E. Millner
*Attorney, Agent, or Firm*—Darby & Darby

[57] ABSTRACT

A locking mechanism for driving a lock bolt comprises a housing. A pinion has an outer circumference and is rotatably mounted in the housing. The pinion has a plurality of teeth and tooth gaps are disposed between adjacent teeth. A predetermined number of the tooth gaps have an abutment that extends outwardly substantially to the outer circumference of the pinion. A toothed rod is coupled to the lock bolt. The toothed rod is engaged by the pinion. A spring loaded detent device arrest the rotational movement of the detent in a switching position of the lock bolt.

7 Claims, 5 Drawing Sheets

LOCKING MECHANISM FOR WINDOWS OR DOORS

FIELD OF THE INVENTION

The present invention relates to a locking mechanism disposed in the sash of a window or a door to drive a lock-bolt fitting. More specifically, the present invention is directed to a locking mechanism with a handle, which is rotatably mounted on the frame, for activating a pinion that engages a toothed rod, such that the toothed rod is coupled to the lock bolts.

BACKGROUND OF THE INVENTION

A drive of this type is known for example from DE-88 14 754.1 U1, in which the locking mechanism with its associated housing has a great structural height, so that the sash, which is made from extruded cavity profiles, must be milled out. The pinion is mounted in the housing of the mechanism, and is activated by the handle. The pinion engages the toothed rod, which is coupled to the lock bolts of the fitting.

Most mechanisms for activating a side/bottom hung sash window or door have the common feature that the handle permits a rotation angle of 180°, within which the lock bolt fitting can be moved from its locking position, through the rotational position, into the tilted position.

SUMMARY OF THE INVENTION

It is an object of the present invention to design a locking mechanism of the type mentioned in the introduction in such a way as to achieve, with minimal structural complication, a process for arresting the lock-bolt fitting in those switching positions which represent the locking position, the rotation position, and the tilt position for a side/bottom hung sash window or door.

According to the present invention, this object is achieved in such a way that the pinion can be arrested in the switching positions of the lock-bolt fitting through a springloaded detent device which engages the tooth gaps of the pinion. The remaining tooth gaps of the pinion have an abutment for the spring-loaded detent means that, extend outwardly as far as, or almost as far, as the outer circumference of the pinion.

The abutment guarantees that the spring-loaded detent means can engage only those tooth gaps of the pinion which correspond to a switching position of the lock-bolt fitting.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF PRESENT INVENTION

Figure 1:
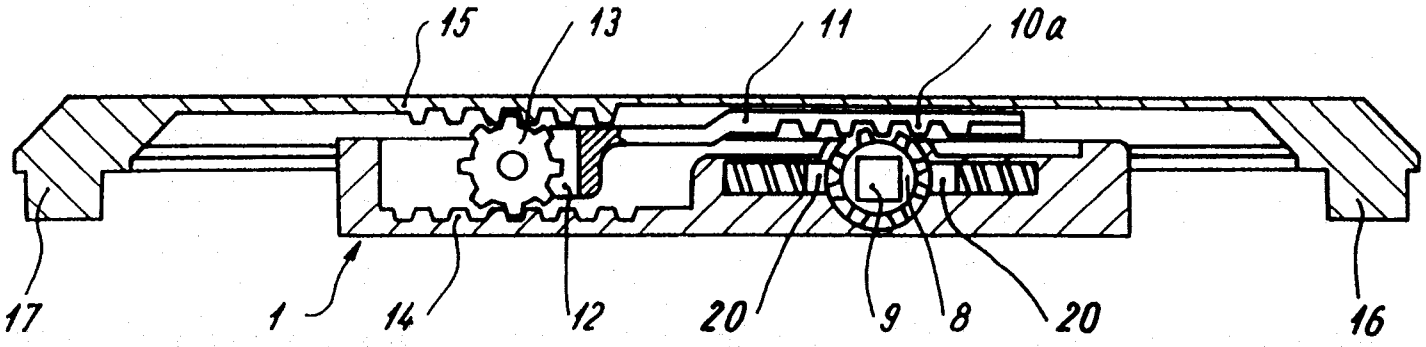
FIG. 1 is a longitudinal section of a locking mechanism with its associated toothed rod according to the present invention.
Figure 3:
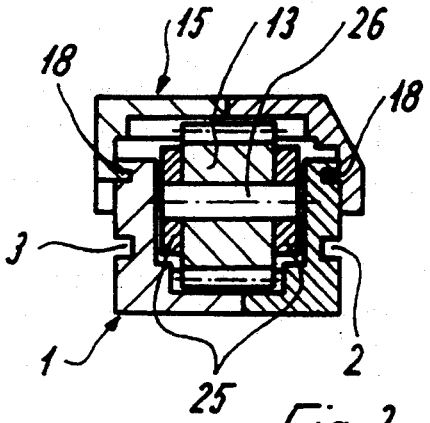
FIG. 3 is a sectional view taken along line III—III of FIG. 2.

Referring now to FIG. 1, the locking mechanism of the present invention includes a housing 1. As illustrated in FIG. 3, housing 1 can be divided longitudinally and equipped with longitudinal grooves 2, 3, so that the housing can be pushed into a groove 4, designed to receive the housing 1 and disposed, for example, in the sash profile 5 of a window or a door on the handle side. The edge strips 6 of the groove 4 engage the longitudinal grooves 2 and 3, respectively.

A pinion 8, which can be activated by a handle 7, is rotatably mounted in the housing 1. Pinion 8 has a square recess 9 to receive a square extension 10 of the handle 7. Pinion 8 engages a row of teeth 10*a* that is part of a slider mechanism 11 that can move linearly. Slide 11 is equipped with a fork piece 12, within which an output pinion 13 is rotatably mounted. Output pinion 13 engages a row or rack of teeth 14 that are fixed in the housing and meshes with a toothed rod 15. Toothed rod 15 has journals 16, 17 at its ends, which are introduced into the holes of lock bolts 27, 28, so that the motion of the toothed rod 15 is transferred to these lock bolts.

Figure 5:
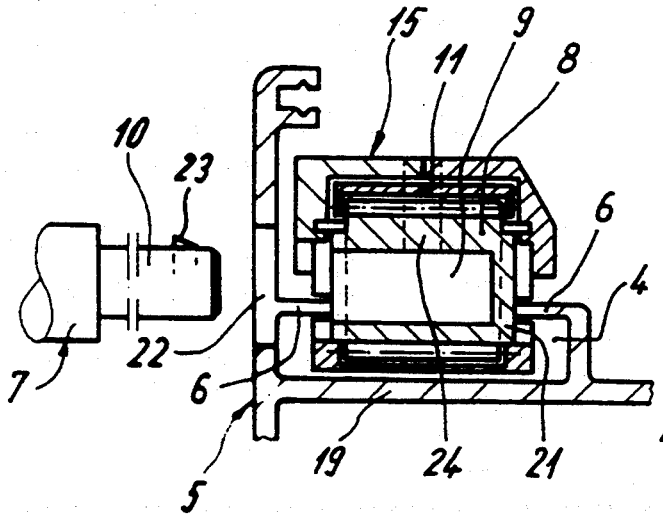
FIG. 5 is a sectional view taken along line V—V of FIG. 4.

Referring now to FIG. 5, the toothed rod 15 is illustrated as being divided longitudinally and has a U-shaped cross section. The toothed rod 15 covers one side of the housing 1. Toothed rod 15 has guide strips 18, which extend inwardly, and engage a second pair of longitudinal grooves of the housing 1 which are disposed next to the upper limit edge of the side walls of the housing 1.

FIG. 5 further shows that the housing 1, in its built-in position, extending close to the base 19 of the groove 4, in the sash profile 5. In the open side of the groove 4, toothed rod 15 extends into the chamber between the sash and the frame. Thus, additional recesses in the sash profile to accommodate the housing and its associated toothed rod 15 are not necessary.

Figure 4:
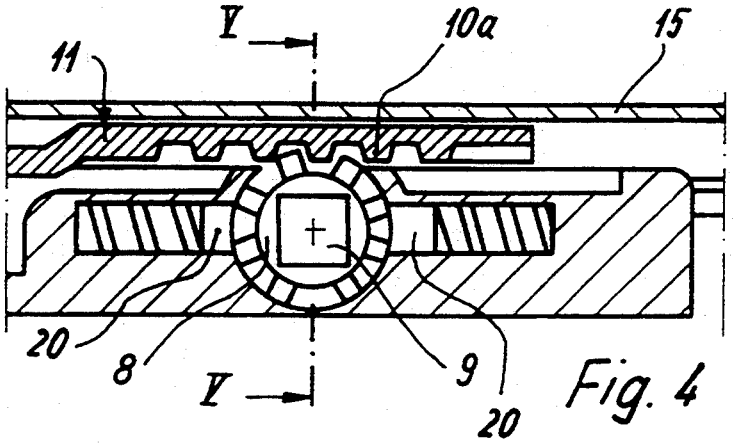
FIG. 4 is an enlarged longitudinal section of the pinion, which can be driven by the handle, with its associated mechanical parts.

FIGS. 4 and 5 show the mounting of the pinion 8 in a magnified representation. The head diameter of the pinion is rotatably mounted in a hole of the housing 1, such that spring-loaded detent device 20 engages the tooth gaps of the pinion 8, and thus arrest the handle 7 in its switching positions and make these positions perceptible to the user.

Pinion 8 has bearing protrusions 21 relative to the root circle of the toothing, to assure a good, load-transmitting bearing to the housing 1. Because the housing 1 is divided longitudinally, no additional precautions need to be taken for axially limiting the pinion 8, since the bearing protrusions 21 also form the axial limitation in the housing 1.

The square recess 9 of the pinion 8 is open toward the stop side of the window sash, so that the square extension 10 of the handle can be pushed in through an appropriate recess 22 in the sash profile 5 thus, the mechanism is also fixed in the longitudinal direction of the groove 4.

A spring-loaded action catch 23 is provided in the square 10 for axially fixing the handle 7. The catch 23 is received in a recess 24 of the pinion 8. The recess 24 extends into the square recess 9. When the mechanism is in its middle position, recess 24 extends from the pinion 8, through slider 11 and through toothed rod 15, to the outside. It is thus possible to activate catch 23 through a mandrel, so that the handle with its square 10 can be uncoupled or disconnected from pinion 8.

Figure 2:
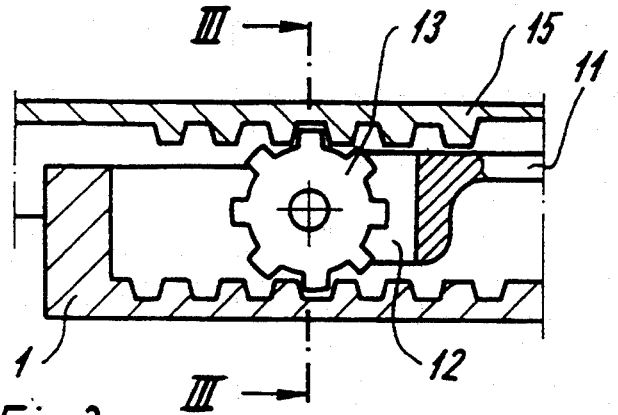
FIG. 2 is an enlarged longitudinal section of the output pinion of the locking mechanism with its associated mechanical parts.

FIGS. 2 and 3 show the mounting of the pinion 13 in the forked piece 12, which has two bearing flanges 25 to receive the bearing bolt pin 26 of the pinion 13. Slider 11 is guided in that region of the toothed rod 15 which is equipped with the row of teeth 10*a*. Slide 11 is additionally guided by means of the bearing flanges 25 in the housing 1.

Figure 6:
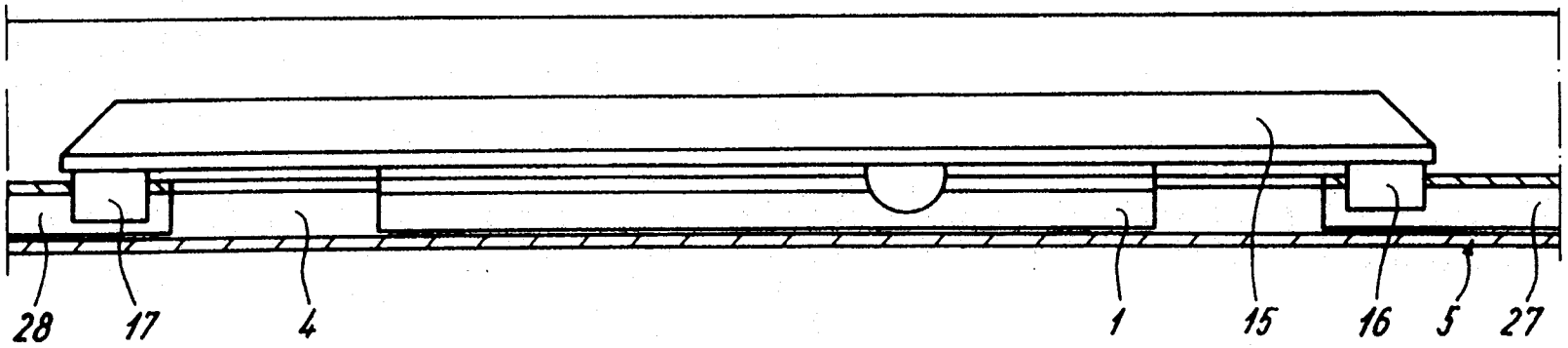
FIG. 6 is a longitudinal sectional view through the sash profile on the handle side with a built-in locking mechanism.

The mechanism is shown in its built-in position in FIG. 6. The journals 16, 17 of the toothed rod 15 engage the holes on the end side of the lock bolts 27, 28. These lock bolts are guided in the groove 4.

Figure 7:
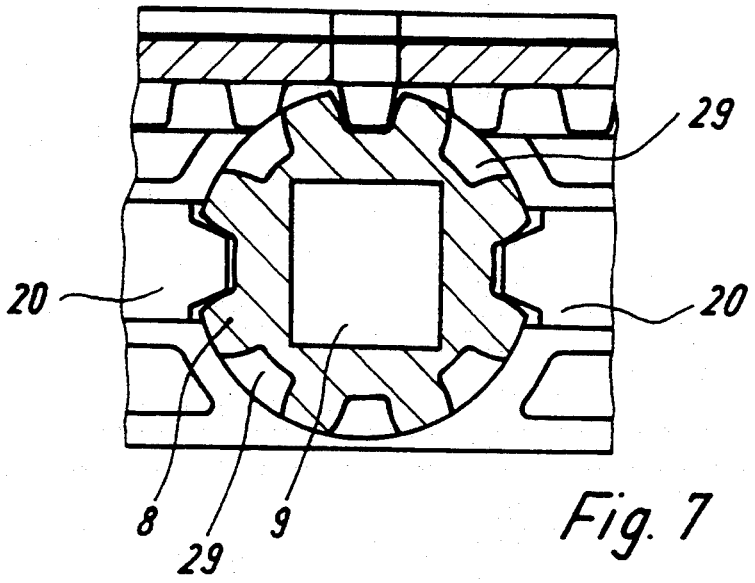
FIG. 7 is a sectional view of the pinion that can be activated by the handle, in its installed position.
Figure 8:
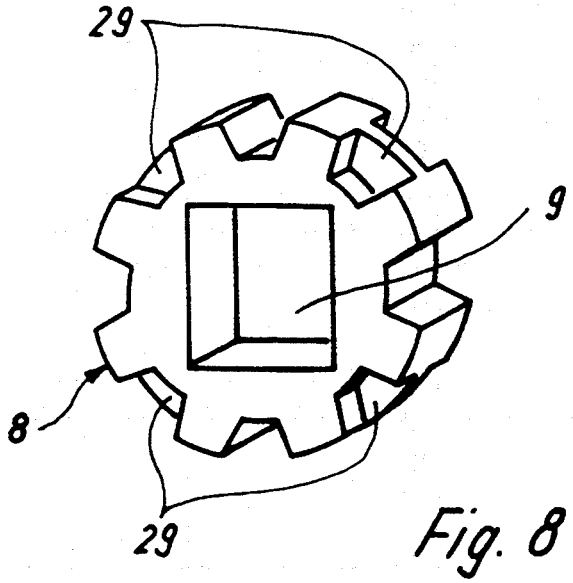
FIG. 8 is a perspective view of the pinion.

In the illustrated embodiment, the locking mechanism is equipped with two mutually opposite, spring-loaded detent devices 20. When the lock-bolt fitting is in a switching position, these detent means mesh with the tooth gaps as illustrated in FIG. 7. FIGS. 7 and 8 show a wall web 29 that is disposed in every other tooth gap of the pinion 8. As the pinion is turned, wall web 29 prevents the detent means 20 from catching in these tooth gaps, which do not correspond to any switching position of the lock-bolt fitting. FIG. 8 shows that the wall webs 29, which connect together two neighboring teeth, are preferably disposed in the center plane which extends perpendicular to the axis of the pinion 8.

In a modification of this design, it is also conceivable that several mutually parallel wall webs can be provided in the tooth gaps described above, or that an abutment with a different geometry can be provided instead of these wall webs. Such an abutment should extend as far as, or nearly as far as, the outer circumference of the pinion 8 and prevents the detent device 20 from entering the tooth gaps while the pinion turns from one switching position to the next.

Figure 9:
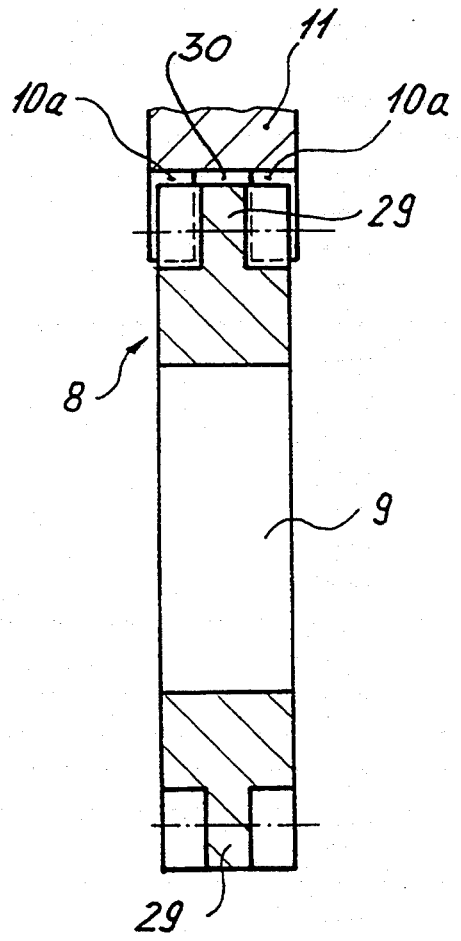
FIG. 9 is a sectional view of the pinion and a portion of the slider.

Since a row of teeth 10*a* works together with the pinion 8, and since the motion of the pinion must also be transmitted to the toothed rod 15 and the engagement of the pinion with the toothed rod 15 must not be impaired, it is necessary to equip the row of teeth or the toothed rod with a recess 30 which receives the wall webs 29 or other abutments of a different shape, disposed in the tooth gaps of the pinion, while the pinion is undergoing its rotational motion (See FIG. 9).

The wall web 29 is disposed in the center plane which extends perpendicular to the axis of the pinion 8 and engages a corresponding longitudinal recess in the row of teeth 10*a* of the slider 11. This recess provides a lateral guide between the pinion 8 and the slider 11.

From the foregoing description, it will be appreciated that the present invention makes available, a compact, cost efficient locking mechanism. Having described the presently preferred exemplary embodiment of a new and improved locking mechanism in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What I claim is:

1. A locking mechanism for driving a lock bolt comprising:

a housing;

a pinion having an outer circumference and being rotatably mounted in said housing, said pinion having a plurality of teeth and tooth gaps disposed between adjacent teeth, a predetermined number of said tooth gaps having an abutment that extends outwardly substantially to the outer circumference of said pinion;

a slider having a plurality of teeth, said slider meshing with said pinion;

a toothed rod being coupled to said lock bolt, said toothed rod being engaged by said slider with said pinion, said slider having a recess to receive said abutment; and spring loaded detent means for arresting the rotational movement of said pinion in a switching position of said lock bolt.

2. The locking mechanism of claim 1, wherein said spring loaded detent means comprises two mutually opposite, spring-loaded detent members.

3. The locking mechanism of claim 1, wherein said abutment is a wall web disposed between two adjacent teeth.

4. The locking mechanism of claim 3, wherein said wall web is disposed in a center plane, said center plane extends perpendicular to a rotational axis of said pinion.

5. The locking mechanism of claim 3, wherein a plurality of wall webs are disposed in the respective tooth gaps of said pinion.

6. The locking mechanism of claim 1, further comprising a handle, said handle being equipped with a spring-loaded catch which engages a recess of said pinion.

7. The locking mechanism of claim 6, wherein said recess, in a predetermined position of the mechanism, extends through the slider and the toothed rod to the outside of said housing.

* * * * *